US007727126B1

(12) United States Patent
Foster et al.

(10) Patent No.: US 7,727,126 B1
(45) Date of Patent: Jun. 1, 2010

(54) RECREATIONAL ROPE TURNING DEVICE AND ASSOCIATED METHOD

(76) Inventors: Tommie Foster, 4157 W. Washington, Chicago, IL (US) 60624; Belvie Foster, 4157 W. Washington, Chicago, IL (US) 60624

( * ) Notice: Subject to any disclaimer, the term of this patent is extended or adjusted under 35 U.S.C. 154(b) by 0 days.

(21) Appl. No.: 12/321,042

(22) Filed: Jan. 15, 2009

Related U.S. Application Data

(60) Provisional application No. 61/134,007, filed on Jul. 3, 2008.

(51) Int. Cl.
*A63B 5/20* (2006.01)

(52) U.S. Cl. ..... 482/81

(58) Field of Classification Search ..... 482/51, 482/81, 82

See application file for complete search history.

(56) References Cited

U.S. PATENT DOCUMENTS 2,911,063 A * 11/1959 Wolfson ..... 185/37
3,013,798 A * 12/1961 Willoughby ..... 482/81
3,107,092 A * 10/1963 Morris et al. ..... 482/82
3,263,995 A * 8/1966 Morrow ..... 482/7
3,411,775 A * 11/1968 Delk, Jr. ..... 482/7
3,612,522 A * 10/1971 Ekonen ..... 482/82
4,529,195 A * 7/1985 Stevens ..... 482/4
4,739,985 A * 4/1988 Rudell et al. ..... 482/81
5,060,936 A * 10/1991 Ekonen et al. ..... 482/81
5,464,376 A 11/1995 Weston
5,961,425 A * 10/1999 Reid et al. ..... 482/81
6,634,994 B2 * 10/2003 Reid et al. ..... 482/81
6,645,123 B1 * 11/2003 Davis ..... 482/81
6,726,604 B2 4/2004 Verdum
7,156,779 B2 * 1/2007 Rudell et al. ..... 482/81

FOREIGN PATENT DOCUMENTS

KR 774919 B1 * 11/2007

* cited by examiner

*Primary Examiner*—Loan H Thanh
*Assistant Examiner*—Victor K Hwang

(57) ABSTRACT

An automated jump rope exercising device includes a frame, a power operated primary drive pulley system, and a plurality of auxiliary driven pulley systems that may be operably coupled to the primary drive pulley system. Each of the auxiliary driven pulley systems may be simultaneously rotated in a first synchronous path during operating conditions based upon input from the primary drive pulley. The device may further include a plurality of arms that may be conjoined to the auxiliary driven pulley systems respectively. A plurality of ropes may be detachably anchored to the arms, and each of the ropes may be simultaneously rotated during operating conditions. A user interface may be coupled to the primary drive pulley system thereby permitting the user to selectively adjust a tension level and rotational speed of the ropes during operating conditions.

19 Claims, 9 Drawing Sheets

RECREATIONAL ROPE TURNING DEVICE AND ASSOCIATED METHOD

CROSS REFERENCE TO RELATED APPLICATIONS

This application claims the benefit of U.S. Provisional Application No. 61/134,007, filed Jul. 3, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to jump ropes and, more particularly, to an automated jump rope exercising device for enabling a single user to independently practice jump rope activities.

2. Prior Art

For many people, the thought of jump rope conjures up wistful memories of childhood, or visions of prizefighters training for a bout—but for thousands of youth worldwide today, jump rope, or skipping, is both serious business, and serious, joyful sport. Although some historians posit an origin for jump rope in the ancient rope making arts of India and China, its origins are in fact obscure. It is known that jump rope arrived in colonial New York with Dutch immigrants in the 1600s, and took firm root there. Here was a sport that required, at minimum, one child and one rope. Jump rope could involve three or more participants, two twirling a longer rope between them, and one skipping as the rope whirled overhead and underfoot. With two ropes twirling, the skipper went "Double Dutch", and the skipping grew more athletic and more complicated. Jump rope gave rise to skipping rhymes, the rhythmic, sing-song chanting of participants in time to the rope's revolutions.

Today, youth all over the world compete in international skipping competitions. Contemporary skippers have incorporated everything from the gymnastic moves of break dancing to the rhythms of hip-hop into their routines, and what began as a children's game has become a big-time sport. Whether skipping solo or with friends, jump rope offers a wholesome and positive social life, quite often to youth in the difficult neighborhoods of inner cities.

If there is any shortcoming or drawback associated with jump rope, it is simply that the more sophisticated forms of skipping have conventionally required at least three participants—one to skip, and two others to twirl the rope(s). It is also possible to fasten one end of the rope to a fixed object, and have one person twirl the rope while the other skips—the twirler, often, being the parent of the skipper.

U.S. Pat. No. 5,464,376 to Weston discloses a motorized jump rope apparatus that includes a first support assembly which includes a first end portion adapted to be supported by a ground surface. A battery-powered motor assembly is connected to the first support assembly, and a first jump rope assembly is connected to the battery-powered motor assembly at its rotational axis. The first end portion of the first support assembly may include a threaded portion adapted to screw into a ground surface. The first jump rope assembly includes a first mid-portion connected to the battery-powered motor assembly at the rotational axis of the battery-powered motor assembly. The second support assembly may further include an output drive assembly which is connected to the jump-rope-receiving portion. A second jump rope assembly and a third support assembly added to the second support assembly and the first jump rope assembly permit two jumpers to jump simultaneously. Unfortunately, this prior art reference does not enable a user to disengage the rope from the motor after the rope is caught in the user's legs.

U.S. Pat. No. 6,645,123 to Davis discloses an apparatus which provides an automatic method for turning both ends of jump rope. Providing a hands free method for turning a jump rope eliminates the need for parents or other children to turn the rope manually. The automatic jump rope apparatus consists of a pair of poles which are spiked on the bottom and fit in weighted bases so that they provide stability on flat surfaces and can be removed from the bases and driven into the ground to provide stability on uneven surfaces. One pole holds one end of the rope and allows it to be turned as rotational force is applied to the other end of the rope by a spring loaded crank assembly located on the opposite pole. The spring loaded crank assembly could be replaced by a battery powered motor which would provide the rotational force necessary to turn the rope. Unfortunately, this prior art reference does not enable a user to disengage the rope from the motor after the rope is caught in the user's legs.

U.S. Pat. No. 6,726,604 to Verdun discloses a jumping apparatus for developing a human's alacrity and also provides an aerobic, anaerobic, and physical exercise to the body. A unique and innovative piece of exercise equipment consisting of a hard plastic or fiberglass-coated octagonal base and a four-sided molded A-frame. An internal battery powers a motor that would be designed to rotate or pulsate back and forth at 180 and/or 360 degrees driving the telescoping shaft. As the individual activates the apparatus, the horizontal extension bar would pulsate or rotate at a desired pace, allowing the jumper to jump over the horizontal extension bar in the defined area. Unfortunately, this prior art reference does not enable a user to simultaneously rotate two jump ropes.

Accordingly, a need remains for an automated jump rope exercising device in order to overcome the above-noted shortcomings. The present invention satisfies such a need by providing a device that is convenient and easy to use, is durable yet lightweight in design, is versatile in its applications, and provides a single user to independently practice jump rope activities.

BRIEF SUMMARY OF THE INVENTION

In view of the foregoing background, it is therefore an object of the present invention to provide an apparatus for enabling a single user to independently practice jump rope activities. These and other objects, features and advantages of the invention are provided by an automated jump rope exercising device for enabling a single user to independently practice jump rope activities.

The automated jump rope exercising device may include a frame adapted to be placed on a ground surface in either an indoor or outdoor environment. In a preferred embodiment, the frame may include a rear brace adapted to be situated on the ground surface and spans along the major width of the frame. The frame may further include a plurality of rectilinear stanchions vertically oriented anterior of the rear brace. A plurality of rectilinear lateral braces preferably have axially opposed ends coupled to the rear brace and top ends of the stanchions respectively, such that the lateral braces remain oriented along an angular position offset from a vertical plane. Such an arrangement helps maintain the frame at a substantially stable position during extended rope jumping activities.

The present invention may further include a power operated primary drive pulley system anchored to the frame, which is selectively operable based upon receipt of a user input at a user interface (described hereinbelow). A plurality of auxiliary driven pulley systems are operably coupled to the primary drive pulley system while being spaced at opposed lateral sides of the frame respectively. Each of the auxiliary driven pulley systems is simultaneously rotated in a first synchronous path during operating conditions based upon receipt of an input from the primary drive pulley respectively. Thus, the primary drive pulley system may operate the device by activating the auxiliary systems concurrently, to simulate the motions of two individuals spinning a jump rope. This allows a single user to achieve the same effect as if three individuals were engaged in the rope jumping activity, which is vital and advantageous for times when additional individuals are not available or when desiring to practice alone.

A plurality of arms are preferably conjoined to the auxiliary driven pulley systems, respectively. Each of the arms has a single and unitary rectilinear shape such that the arms linearly extend parallel to the driven shaft. Further, each of the arms is simultaneously rotated in a second synchronous path during operating conditions based upon receipt of an input from the auxiliary driven pulleys respectively. As can be seen in the figures, the first and second synchronous paths are registered orthogonal to each other so that the arms rotate in a separate plane from the driven pulley systems, respectively.

The present invention may further include a plurality of ropes anchored to the arms respectively. Each of the ropes is simultaneously rotated in a third synchronous path during operating conditions based upon receipt of an input from the arms respectively. Notably, the second and third synchronous paths are coaxially oriented about a fulcrum axis defined at an upper end of the frame.

The ropes preferably span along a major width of the frame and remain inwardly situated from the auxiliary driven pulley systems respectively. Accordingly, while the device is in operation, the arms rotate in a manner that simulates the actions of a person's wrists generating circular motions to thereby spin the rope and allow a user to jump the rope at each revolution. Of course, the ropes may be formed of a desired length to allow sufficient slack to graze the ground at the bottom of the rotation, and rise above the user's head at the top of the rotation.

A user interface is coupled to the primary drive pulley system for generating and transmitting a control signal thereto upon receipt of the user input. The control signal is received by a variable speed motor (described herein below) and adapts a rotational speed of the arms thereby permitting the user to selectively adjust a tension level of the ropes during operating conditions. In this manner, the user may increase the speed of the ropes to force the user to jump at reduced intervals as the rope rotates more quickly. Further, increasing the tension of the ropes reduces the slack therein and causes the rope to remain higher off of the ground surface at the bottom of the rotation, thereby forcing the user to jump higher with each rotation. These features are vital and advantageous for allowing a user to practice at multiple skill and speed levels, increasing the difficulty of the exercise and boosting calorie burn, or simply creating a more entertaining activity.

The primary drive pulley system preferably includes the aforementioned variable speed motor that is connected to the frame and the user interface, respectively. The clockwise and counter clockwise directional rotation of the motor allows the user to alternate the direction of the ropes, either rotating around toward the front of the user, or from behind.

The primary drive pulley system further includes a drive shaft directly coupled to the variable speed motor and is rotated along clockwise and counter clockwise directions registered orthogonally to the first synchronous path. A drive pulley is statically attached to the drive shaft and is contemporaneously rotated with the drive shaft along the clockwise and counter clockwise directions. Also, a driven pulley is axially offset from the drive pulley.

The primary drive pulley system further includes a drive chain wrapped about the drive and driven pulleys respectively such that the drive and driven pulleys synchronously rotate along the clockwise and counter clockwise directions and further rotates about mutually exclusive axes extending parallel to each other, for example. In operation, the variable speed motor rotates the drive pulley, which in turn rotates the driven pulley by way of the drive chain, thereby simultaneously rotating the driven shaft affixed thereto, all while stabilized by the frame.

The primary drive pulley system further includes a rectilinear driven shaft spanning along the major width of the frame and coaxially aligned with the driven pulley. The driven shaft further is statically affixed to the driven pulley and thereby rotates in sync therewith. Axially opposed ends of the driven shaft are statically mated to the primary driven pulley systems respectively for maintaining the driven shaft at a substantially stable position during operating conditions.

Notably, the frame remains statically positioned on the ground surface while the driven shaft rotates. In this manner, as the driven shaft is rotated by the motor, the first driven gear may rotate therewith. As a result, the driven chain causes the second driven gear and arms to spin along therewith.

In an exemplary embodiment of the present invention, each of the auxiliary driven pulley systems preferably includes a first driven gear statically affixed to a corresponding one of the driven shaft ends. A driven chain is preferably wrapped about the first driven gear. A second driven gear may be statically affixed to a corresponding one of the arms while being situated at a top end of the frame. The second driven gear may also be operably coupled to the driven chain such that the corresponding arm is caused to rotate in sync with the driven shaft.

Each of the arms may further include a drive wheel statically mounted about a corresponding one of the arms such that the drive wheel is rotatably in sync therewith. A rope clutch may be detachably connected to the drive wheel and is caused to rotate in sync therewith, at each auxiliary driven pulley system. The rope clutch is rotatably coupled about the corresponding arm to permit free rotation thereabout during disengaged positions (described hereinbelow).

Each arm may further include a terminal wheel releasably coupled to the rope clutch and rotatably affixed about the corresponding arm. Advantageously, the terminal wheel is caused to rotate about the corresponding arm and along the second rotational path when the rope clutch is engaged with the terminal/drive wheels such that the terminal wheel is coaxially rotated in sync with the drive wheel during rope jumping procedures.

If the rope gets caught in the user's feet, the rope clutch is axially displaced along the corresponding arm and away from the terminal wheel. This result is effectuated when the tension of the ropes rise above a maximum threshold tension level. The maximum threshold tension level may be calibrated by adjusted a tension level of the spring members. Thus, the rope clutch becomes disengaged from the terminal wheel and the drive wheel to thereby disable a rotational movement of the ropes along the third synchronous path respectively.

Advantageously, disengagement of the rope clutch from the terminal and drive wheels permits the ropes to remain at a static non-rotational position while the corresponding arm and the drive wheel freely rotate along the second rotational path. Such a disengaging effect between the rope clutch and the terminal/drive wheels permits the user to detangle the ropes from his legs, for example, and step away from the second synchronous path while the motor is continuously running. The tension levels in the ropes then drop and a corresponding spring member (described hereinbelow) returns to equilibrium. At equilibrium, the clutch engages the terminal/drive wheels so the user can restart the rope jumping activities without having to toggle the motor between on/off modes.

Each of the terminal wheels preferably includes a pair of diametrically opposed rectilinear rods extending radially away from a corresponding one of the terminal wheels respectively. Such ropes may be affixed to distal ends of the rods such that the ropes are prohibited from rotating along the third synchronous path when their tension levels rise above the maximum threshold tension level, respectively.

Each of the arms preferably includes a resilient spring member concentrically situated thereabout and configured in such a manner that the spring member compresses along a rectilinear path defined parallel to the rear brace and a longitudinal length of the arms when the rope tension levels are above the maximum rope tension level, respectively. Each arm may further include a locking member removably coupled to a medial end of each arm, respectively, for prohibiting each spring member from prematurely disengaging the corresponding arm during compression and expansion movements.

The spring members remain at equilibrium along the rectilinear path as the ropes rotate along the third synchronous path and thereby maintain the rope tension levels below the maximum threshold tension level. This allows the terminal wheels to remain axially urged against the rope clutch and thereby maintain direct engagement therewith.

When the ropes get tangled in the user's feet, the spring members are urged to a stressed position by compressing along a second direction defined along the rectilinear path when the tension level of the ropes rise above the maximum threshold tension level. This causes the terminal wheels to axially retract away from the corresponding rope clutches and thereby stop rotating along the second synchronous path.

The present invention further includes a method for enabling a single user to independently practice jump rope activities. Such a method may include the chronological steps of providing and placing a frame on a ground surface; providing and anchoring a power operated primary drive pulley system to the frame; providing and coupling a user interface to the primary drive pulley system such that the primary drive pulley system is selectively operable as desired by the user; providing and operably coupling a plurality of auxiliary driven pulley systems to the primary drive pulley system while maintaining the auxiliary driven pulley systems spaced at opposed lateral sides of the frame respectively; providing and conjoining a plurality of arms to the auxiliary driven pulley systems respectively; providing and detachably anchoring a plurality of ropes to the arms respectively; and adapting a rotational speed of the arms and thereby permitting the user to selectively adjust a tension level of ropes during operating conditions by generating and transmitting a user input to the user interface.

The method may further include the steps of: in response to receiving the user input, the user interface generating and transmitting a control signal to the primary pulley system; as well as in response to receiving the control signal, the primary drive pulley system generating and transmitting an input to each of the auxiliary driven pulley systems; as well as in response to receiving the input from the primary drive pulley system, the auxiliary driven pulley systems is simultaneously rotated in a first synchronous path during operating conditions.

The method may further include steps of: the auxiliary driven pulley systems generating and transmitting an input to the arms respectively; and in response to receiving the input from the auxiliary driven pulley systems, the arms is simultaneously rotated in a second synchronous path during operating conditions.

Thereafter, the arms generate and transmit an input to the ropes respectively; and in response to receiving the input from the arms, each of the ropes is simultaneously rotated in a third synchronous path during operating conditions respectively. During such method steps, the ropes span along a major width of the frame and remain inwardly situated from the auxiliary driven pulley systems respectively. Also, the first and second synchronous paths remain registered orthogonal to each other, while the second and third synchronous paths are coaxially oriented about a fulcrum axis defined at an upper end of the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
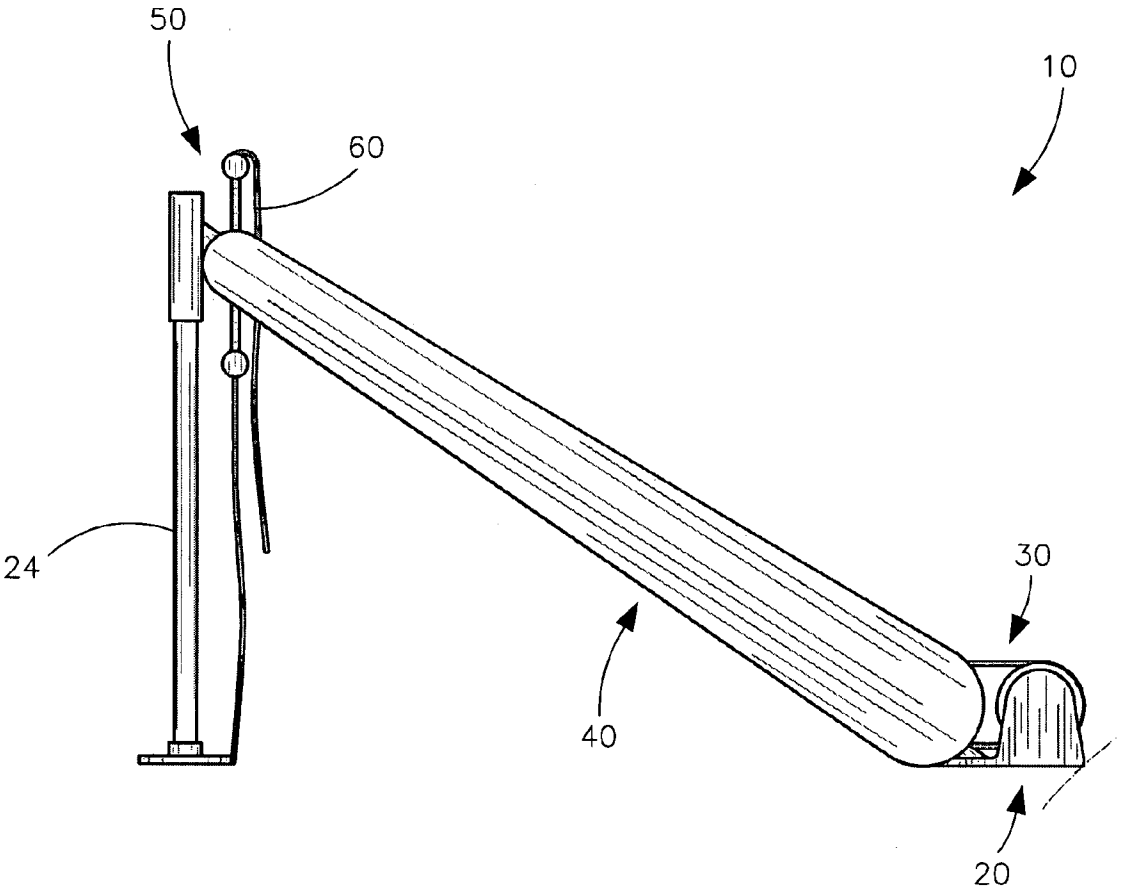
FIG. 1 is a side elevational view showing a recreational rope turning device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-8 by the reference numeral 10 and is intended to provide an automated jump rope exercising device. It should be understood that the automated jump rope exercising device 10 may be used to allow a single user to practice solo rope jumping activities in many different environments.

Referring initially to FIGS. 1-5, the automated jump rope exercising device 10 may include a frame 20 adapted to be placed on a ground surface in either an indoor or outdoor environment. In a preferred embodiment, the frame 20 may include a rear brace 22 adapted to be situated on the ground surface and spans along the major width of the frame 20. The frame 20 may further include a plurality of rectilinear stanchions 24 vertically oriented anterior of the rear brace 22. A plurality of rectilinear lateral braces 26 preferably have axially opposed ends 39*a*, 39*b* coupled to the rear brace 22 and top ends of the stanchions 24 respectively, such that the lateral braces 26 remain oriented along an angular position offset from a vertical plane. Such an arrangement helps maintain the frame 20 at a substantially stable position during extended rope jumping activities.

Still referring to FIGS. 1-5, the present invention may further include a power operated primary drive pulley system 30 anchored to the frame 20, which is selectively operable based upon receipt of a user input at a user interface 70 (described hereinbelow). A plurality of auxiliary driven pulley systems 40 are operably coupled to the primary drive pulley system 30 while being spaced at opposed lateral sides 21*a*, 21*b* of the frame 20 respectively. Each of the auxiliary driven pulley systems 40 is simultaneously rotated in a first synchronous 90 path during operating conditions based upon receipt of an input from the primary drive pulley respectively. The first synchronous 90 path is identified by the curvilinear arrows in FIG. 2. Thus, the primary drive pulley system 30 may operate the device 10 by activating the auxiliary systems concurrently, to simulate the motions of two individuals spinning a jump rope. This allows a single user to achieve the same effect as if three individuals were engaged in the rope jumping activity, which is vital and advantageous for times when additional individuals are not available or when desiring to practice alone.

Referring to FIGS. 2-6*b*, a plurality of arms 50 are preferably conjoined to the auxiliary driven pulley systems 40, respectively. Each of the arms 50 has a single and unitary rectilinear shape such that the arms 50 linearly extend parallel to the driven shaft 38. Further, each of the arms 50 is simultaneously rotated in a second synchronous 91 path during operating conditions based upon receipt of an input from the auxiliary driven pulley systems 40, respectively. Such second synchronous 91 paths are identified by the curvilinear arrows in FIGS. 6*a* and 6*b*. As can be seen in the figures, the first and second synchronous 91 paths are registered orthogonal to each other so that the arms 50 rotate in a separate plane from the driven pulley systems 40, respectively.

As perhaps best shown in FIGS. 2, 3, 5 and 7, the present invention may further include a plurality of ropes 60 anchored to the arms 50 respectively. Each of the ropes 60 is simultaneously rotated in a third synchronous 92 path during operating conditions based upon receipt of an input from the arms 50 respectively. Such third synchronous 92 paths are identified by the curvilinear arrows in FIG. 2. Notably, the second and third synchronous 92 paths are coaxially oriented about a fulcrum axis defined at an upper end of the frame 20, as shown in FIGS. 3, 5 and 6*a*-6*b*, for example.

The ropes 60 preferably span along a major width of the frame 20 and remain inwardly situated from the auxiliary driven pulley systems 40 respectively. Accordingly, while the device 10 is in operation, the arms 50 rotate in a manner that simulates the actions of a person's wrists generating circular motions to thereby spin the ropes 60 and allow a user to jump the ropes 60 at each revolution. Of course, the ropes 60 may be formed of a desired length to allow sufficient slack to graze the ground at the bottom of the rotation, and rise above the user's head at the top of the rotation.

Figure 8:
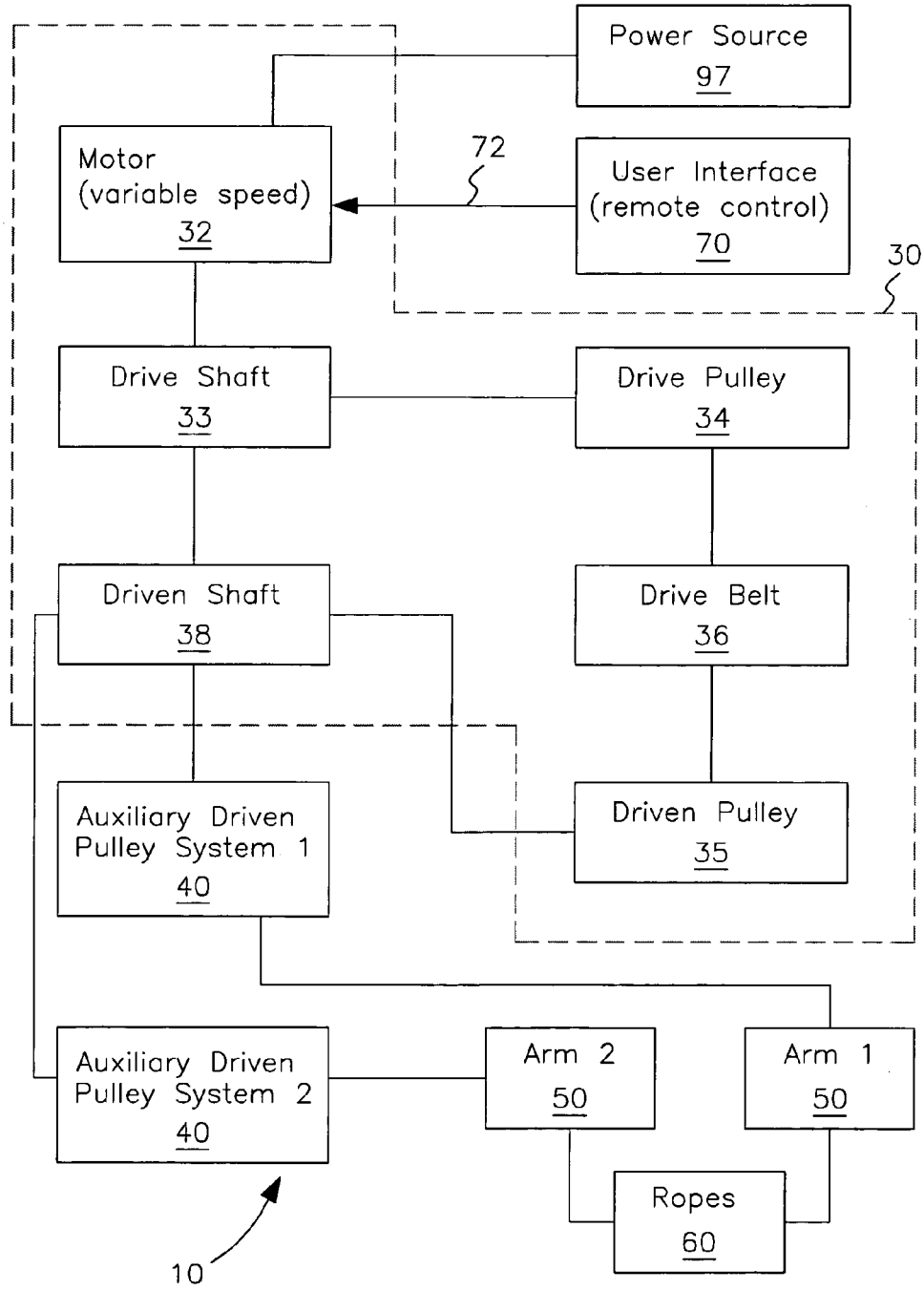
FIG. 8 is a schematic block diagram showing the interrelationship between the major components of the present invention.

Referring now to FIG. 8, a schematic block diagram is illustrated wherein a user interface 70 is coupled to the primary drive pulley system 30 for generating and transmitting a control signal 72 thereto upon receipt of the user input. The control signal 72 is received by a variable speed motor 32 (described herein below) and adapts a rotational speed of the arms 50 thereby permitting the user to selectively adjust a tension level of the ropes 60 during operating conditions. In this manner, the user may increase the speed of the ropes 60 to force the user to jump at reduced intervals as the ropes 60 rotate more quickly. Further, increasing the tension of the ropes 60 reduces the slack therein and causes the ropes 60 to remain higher off of the ground surface at the bottom of the rotation, thereby forcing the user to jump higher with each rotation. These features are vital and advantageous for allowing a user to practice at multiple skill and speed levels, increasing the difficulty of the exercise and boosting calorie burn, or simply creating a more entertaining activity.

As perhaps best shown in FIGS. 3, 4, 5 and 8, the primary drive pulley system 30 preferably includes the aforementioned variable speed motor 32 that is connected to the frame 20 and the user interface 70, respectively. A conventional power source 97 supplies power to the motor 32. The clockwise and counter clockwise directional rotation of the motor 32 allows the user to alternate the direction of the ropes 60, either rotating around toward the front of the user, or from behind.

Figure 2:
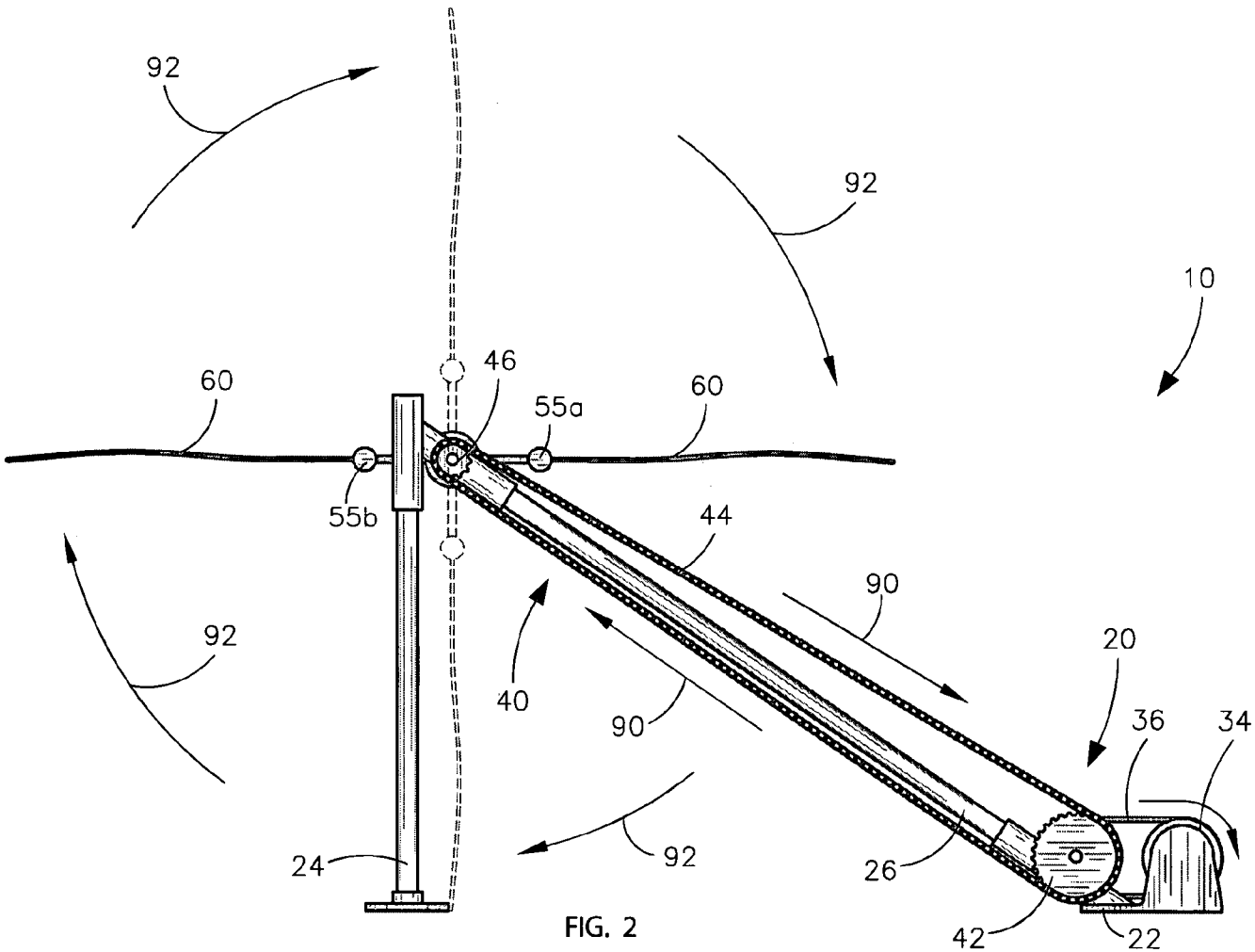
FIG. 2 is a side elevational view showing the movements of the auxiliary driven pulley systems, arms and ropes along the first, second and third synchronous paths, respectively.
Figure 3:
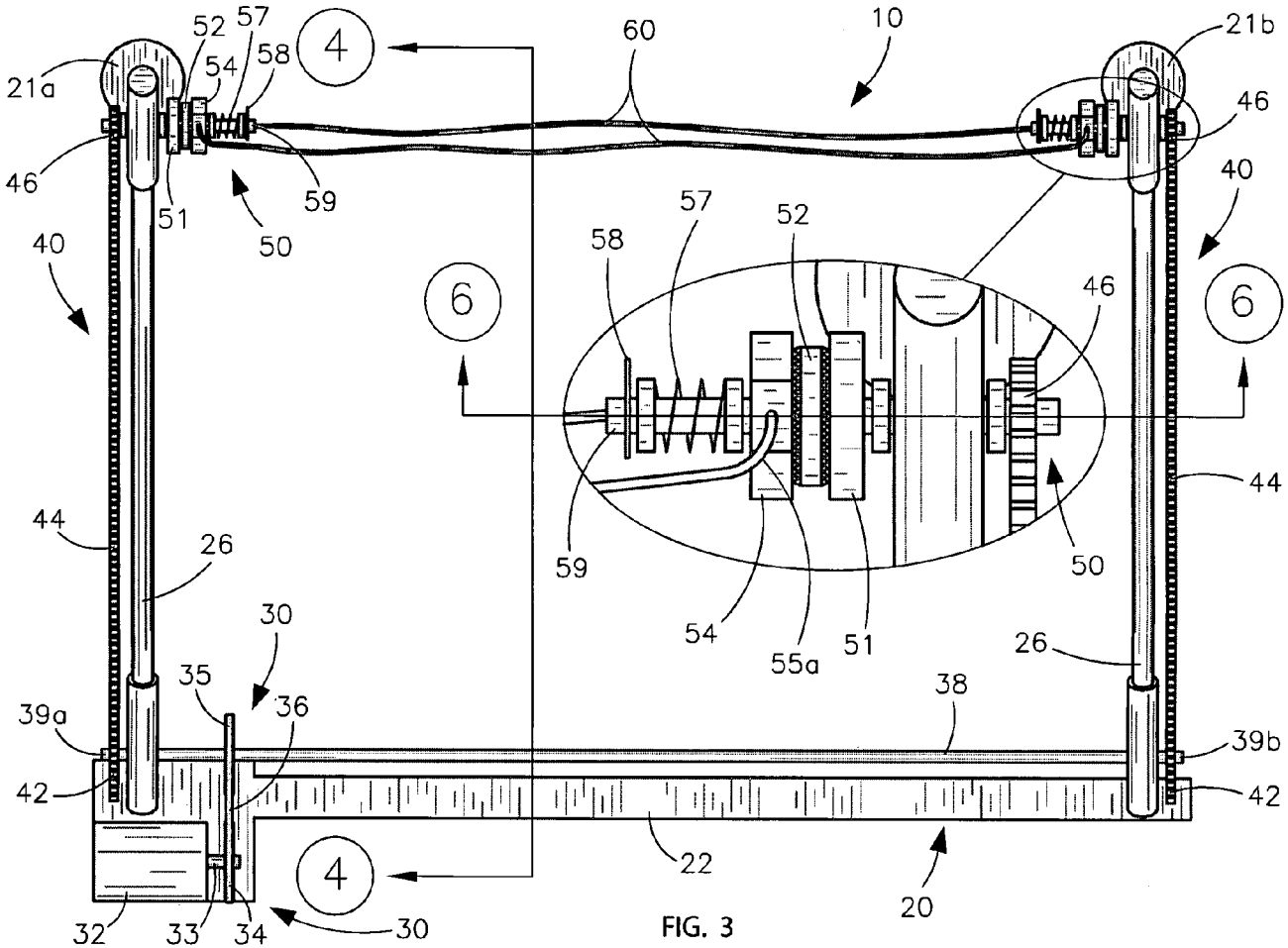
FIG. 3 is a top elevational of the present invention showing an enlarged view of an exemplary arm.
Figure 4:
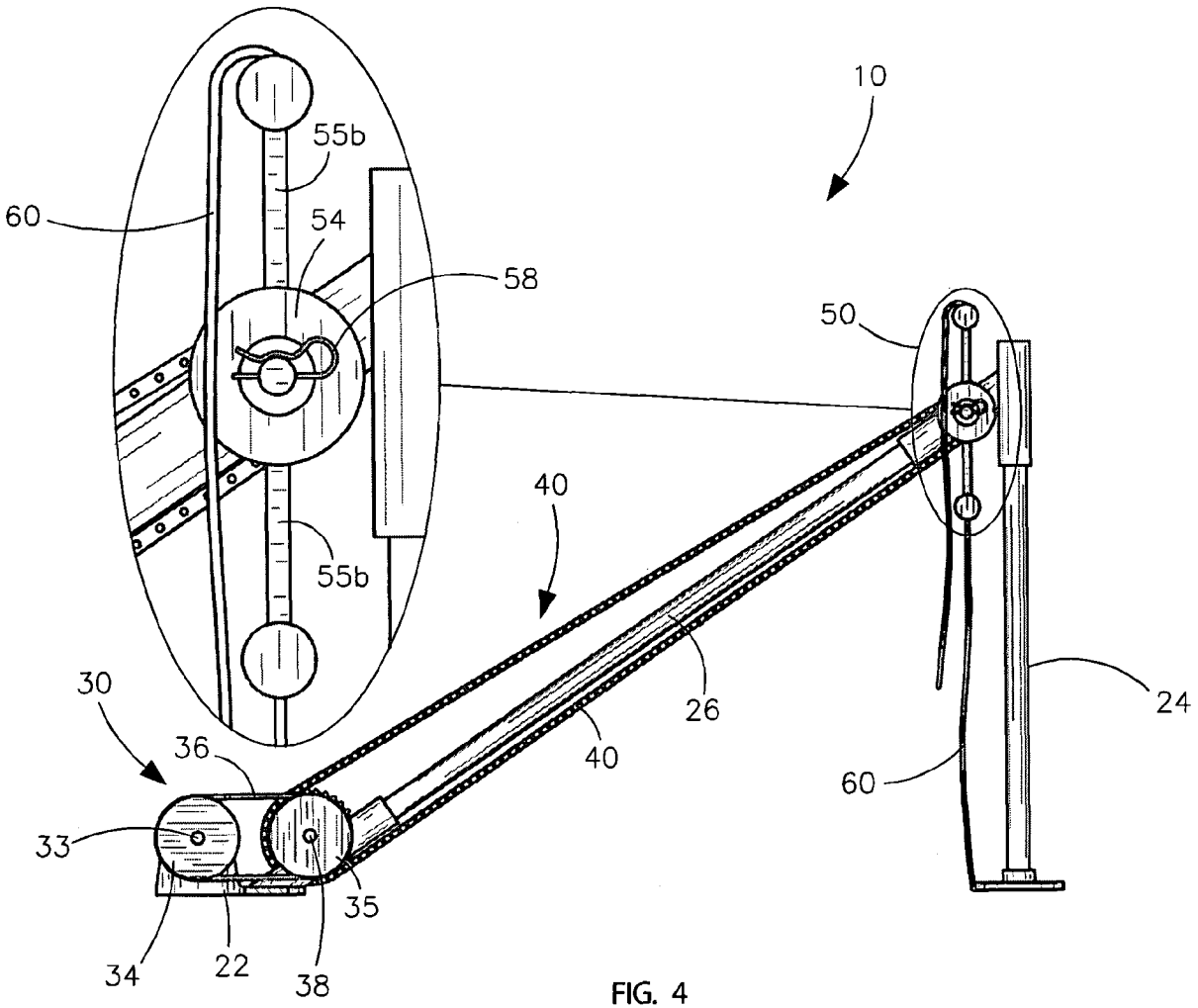
FIG. 4 is a cross-sectional view taken along line 4-4 in FIG. 3 showing an exemplary auxiliary driven pulley system and associated arm.
Figure 5:
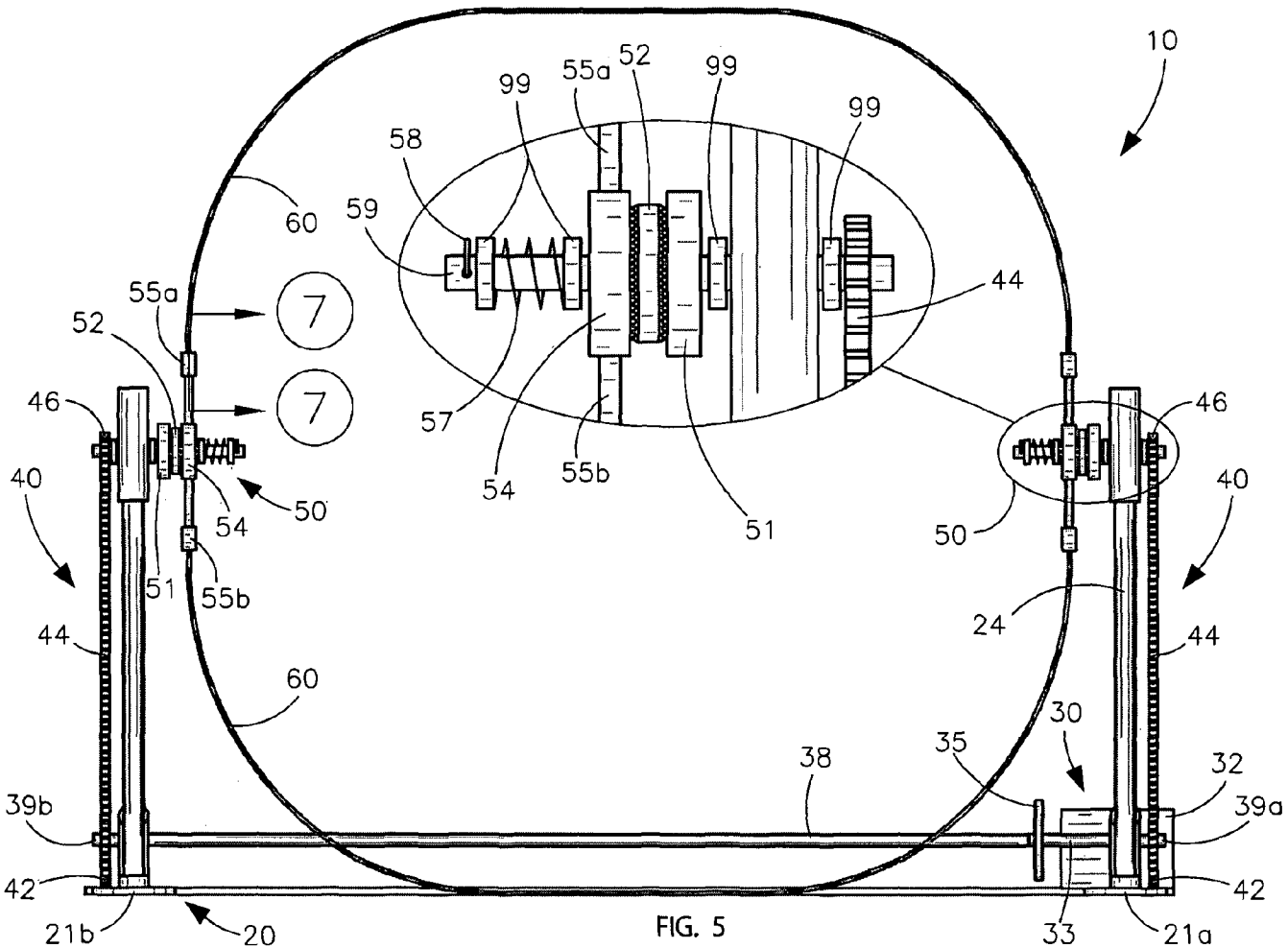
FIG. 5 is front elevational view of the present invention showing an enlarged view of the terminal and drive wheels engaged with the rope clutch.

The primary drive pulley system 30 further includes a drive shaft 33 directly coupled to the variable speed motor 32 and is rotated along clockwise and counter clockwise directions registered orthogonally to the first synchronous 90 path, as perhaps best shown in FIGS. 2 and 4. A drive pulley 34 is statically attached to the drive shaft 33 and is contemporaneously rotated with the drive shaft 33 along the clockwise and counter clockwise directions. Also, a driven pulley 35 is axially offset from the drive pulley.

The primary drive pulley system 30 further includes a drive chain 36 wrapped about the drive and driven pulleys 34, 35 respectively such that the drive and driven pulleys 34, 35 synchronously rotate along the clockwise and counter clockwise directions and further rotates about mutually exclusive axes extending parallel to each other, as perhaps best shown in FIGS. 2-5, for example. In operation, the variable speed motor 32 rotates the drive pulley 34, which in turn rotates the driven pulley 35 by way of the drive chain 36, thereby simultaneously rotating the driven shaft 38 affixed thereto, all while stabilized by the frame 20.

The primary drive pulley system 30 further includes a rectilinear driven shaft 38 spanning along the major width of the frame 20 and coaxially aligned with the driven pulley 35. The driven shaft 38 further is statically affixed to the driven pulley 35 and thereby rotates in sync therewith. Axially opposed ends 39*a*, 39*b* of the driven shaft 38 are statically mated to the primary driven pulley systems 40 respectively for maintaining the driven shaft 38 at a substantially stable position during operating conditions.

Notably, the frame 20 remains statically positioned on the ground surface while the driven shaft 38 rotates. In this manner, as the driven shaft 38 is rotated by the motor 32, the first driven gear 42 may rotate therewith. As a result, the driven chain 44 causes the second driven gear 46 and arms 50 to spin along therewith.

Now referring to FIGS. 3-7, in an exemplary embodiment of the present invention, each of the auxiliary driven pulley systems 40 preferably includes a first driven gear 42 statically affixed to a corresponding one of the driven shaft 38 ends. A driven chain 44 is preferably wrapped about the first driven gear 42. A second driven gear 46 may be statically affixed to a corresponding one of the arms 50 while being situated at a top end of the frame 20. The second driven gear 46 may also be operably coupled to the driven chain 44 such that the corresponding arm 50 is caused to rotate in sync with the driven shaft 38.

Each of the arms 50 may further include a drive wheel 51 statically mounted about a corresponding one of the arms 50 such that the drive wheel 51 is rotatably in sync therewith. A rope clutch 52 may be detachably connected to the drive wheel 51 and is caused to rotate in sync therewith, at each auxiliary driven pulley system 40. The rope clutch 52 is rotatably coupled about the corresponding arm to permit free rotation thereabout during disengaged positions (described hereinbelow).

Each arm may further include a terminal wheel 54 releasably coupled to the rope clutch 52 and rotatably affixed about the corresponding arm. Advantageously, the terminal wheel 54 is caused to rotate about the corresponding arm and along the second synchronous 91 path when the rope clutch 52 is engaged with the terminal/drive wheel 51s such that the terminal wheel 54 is coaxially rotated in sync with the drive wheel 51 during rope jumping procedures.

If the rope gets caught in the user's feet, the rope clutch 52 is axially displaced along the corresponding arm 50 and away from the terminal wheel 54. This result is effectuated when the tension of the ropes 60 rise above a maximum threshold tension level. The maximum threshold tension level may be calibrated by adjusted a tension level of the spring members 57. Thus, the rope clutch 52 becomes disengaged from the terminal wheel 54 and the drive wheel 51 to thereby disable a rotational movement of the ropes 60 along the third synchronous path 92 respectively.

Advantageously, disengagement of the rope clutch 52 from the terminal and drive wheels 51 permits the ropes 60 to remain at a static non-rotational position while the corresponding arm 50 and the drive wheel 51 freely rotate along the second synchronous path 91. Such a disengaging effect between the rope clutch 52 and the terminal/drive wheel 51s permits the user to detangle the ropes 60 from his legs, for example, and step away from the second synchronous path 91 while the motor 32 is continuously running. The tension levels in the ropes 60 then drop and a corresponding spring member 57 (described hereinbelow) returns to equilibrium. At equilibrium, the clutch engages the terminal/drive wheels 54, 51 so the user can restart the rope jumping activities without having to toggle the motor 32 between on/off modes.

Figure 6A:
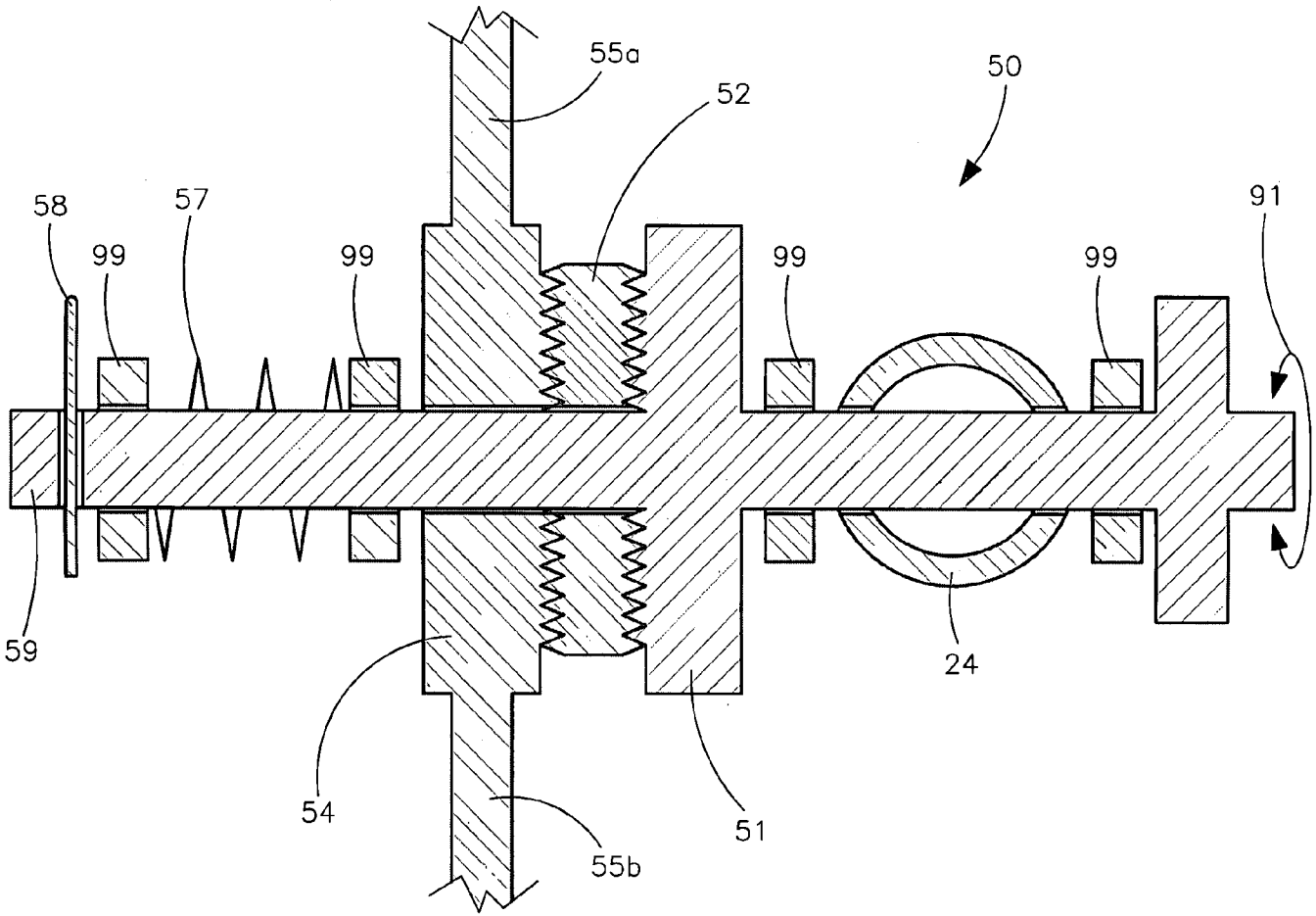
FIGS. 6*a*-6*b* are enlarged cross-sectional views taken along line 6-6 in FIG. 3 wherein the rope clutch is engaged and disengaged from the terminal and drive wheels, respectively.
Figure 6B:
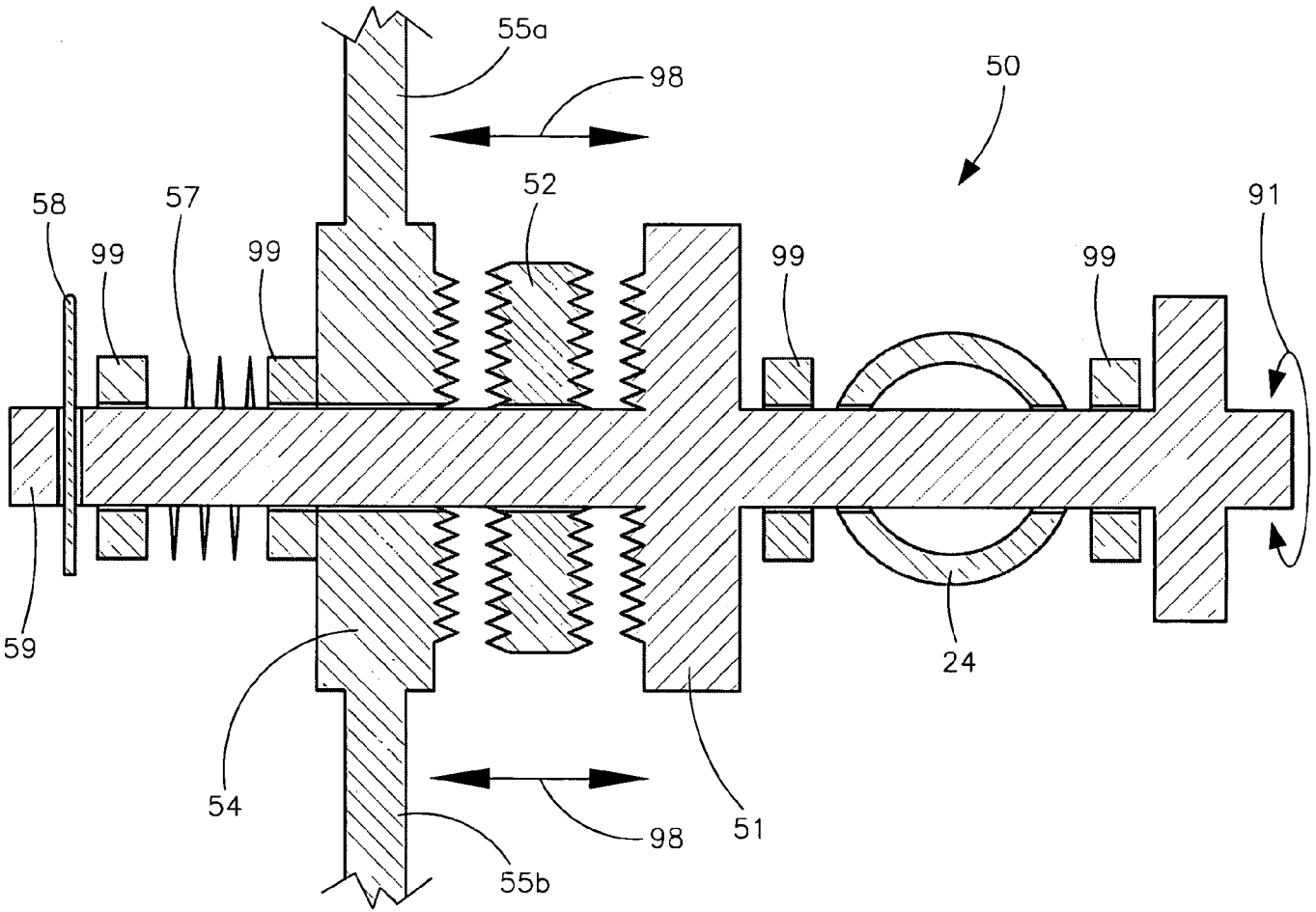
Figure 7:
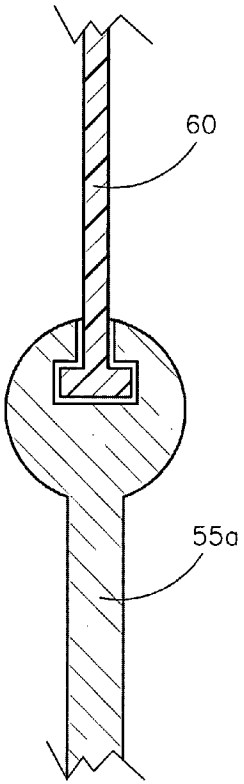
FIG. 7 is an enlarged cross-sectional view taken along line 7-7 in FIG. 5 showing the rope attached to an end of the arm.

Referring to FIGS. 6*a*, 6*b* and 7, each of the terminal wheels 54 preferably includes a pair of diametrically opposed rectilinear rods 55*a*, 55*b* extending radially away from a corresponding one of the terminal wheels 54 respectively. Such ropes 60 may be affixed to distal ends of the rods 55*a*, 55*b* such that the ropes 60 are prohibited from rotating along the third synchronous 92 path when their tension levels rise above the maximum threshold tension level, respectively.

As perhaps best shown in FIGS. 4, 5, 6*a* and 6*b*, each of the arms 50 preferably includes the resilient spring members 57 concentrically situated thereabout and configured in such a manner that the spring members 57 compresses along a rectilinear path 98 defined parallel to the rear brace 22 and a longitudinal length of the arms 50 when the rope tension levels are above the maximum rope tension level, respectively. Each arm 50 may further include a locking member 58 removably coupled to a medial end 59 of each arm 50, respectively, for prohibiting each spring member 57 from prematurely disengaging the corresponding arm 50 during compression and expansion movements.

As perhaps best shown in FIGS. 6*a-b*, the spring members 57 remain at equilibrium along the rectilinear path 98 as the ropes 60 rotate along the third synchronous path 92 and thereby maintain the rope tension levels below the maximum threshold tension level. This allows the terminal wheels 54 to remain axially urged against the rope clutch 52 and thereby maintain direct engagement therewith. Washers 99 are spaced along the arms 50 to prevent undesirable contact between the stanchions 24 and the drive wheel 51. Washers 99 also protect the spring member 57 from being damaged during compression and expansion.

When the ropes 60 get tangled in the user's feet, the spring members 57 are urged to a stressed position by compressing along a second linear direction defined along the rectilinear path 98 when the tension level of the ropes 60 rise above the maximum threshold tension level. This causes the terminal wheels 54 to axially retract away from the corresponding rope clutches 52 and thereby stop rotating along the second synchronous path 91.

The present invention further includes a method for enabling a single user to independently practice jump rope activities. Such a method may include the chronological steps of providing and placing a frame 20 on a ground surface; providing and anchoring a power operated primary drive pulley system 30 to the frame 20; providing and coupling a user interface 70 to the primary drive pulley system 30 such that the primary drive pulley system 30 is selectively operable as desired by the user; providing and operably coupling a plurality of auxiliary driven pulley systems 40 to the primary drive pulley system 30 while maintaining the auxiliary driven pulley systems 40 spaced at opposed lateral sides 21*a*, 21*b* of the frame 20 respectively; providing and conjoining a plurality of arms 50 to the auxiliary driven pulley systems 40 respectively; providing and detachably anchoring a plurality of ropes 60 to the arms 50 respectively; and adapting a rotational speed of the arms 50 and thereby permitting the user to selectively adjust a tension level of ropes 60 during operating conditions by generating and transmitting a user input to the user interface 70.

The method may further include the steps of: in response to receiving the user input, the user interface 70 generating and transmitting a control signal 72 to the primary pulley system; as well as in response to receiving the control signal 72, the primary drive pulley system 30 generating and transmitting an input to each of the auxiliary driven pulley systems 40; as well as in response to receiving the input from the primary drive pulley system 30, the auxiliary driven pulley systems 40 is simultaneously rotated in a first synchronous path 90 during operating conditions.

The method may further include steps of: the auxiliary driven pulley systems 40 generating and transmitting an input to the arms 50 respectively; and in response to receiving the input from the auxiliary driven pulley systems 40, the arms 50 simultaneously rotate in a second synchronous path 91 during operating conditions.

Thereafter, the arms 50 generate and transmit an input to the ropes 60 respectively; and in response to receiving the input from the arms 50, each of the ropes 60 is simultaneously rotated in a third synchronous path 92 during operating conditions respectively. During such method steps, the ropes 60 span along a major width of the frame 20 and remain inwardly situated from the auxiliary driven pulley systems 40 respectively. Also, the first and second synchronous paths 91 remain registered orthogonal to each other, while the second and third synchronous paths 92 are coaxially oriented about a fulcrum axis defined at an upper end of the frame 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An automated jump rope exercising device for enabling a single user to independently practice jump rope activities, said automated jump rope exercising device comprising:

a portable frame adapted to be placed on a ground surface;

a power operated primary drive pulley system anchored to said frame;

at least two auxiliary driven pulley systems mechanically coupled to said primary drive pulley system at opposed lateral sides of said frame respectively, each of said auxiliary driven pulley systems being simultaneously rotated in a first synchronous path during operating conditions;

a plurality of arms conjoined to said auxiliary driven pulley systems respectively, each of said arms being simultaneously rotated in a second synchronous path during operating conditions;

a plurality of ropes anchored to said arms respectively, each of said ropes being simultaneously rotated in a third synchronous path during operating conditions based upon receipt of an input from said arms respectively, wherein said ropes span along a major width of said frame and remain inwardly situated from said auxiliary driven pulley systems respectively; and a user interface coupled to said primary drive pulley system for generating and transmitting a control signal thereto, said control signal for adapting a rotational speed of said arms and thereby permitting the user to selectively adjust a tension level of said ropes during operating conditions.

2. The automated jump rope exercising device of claim 1, wherein said primary drive pulley system comprises:

a variable speed motor connected to said frame and said user interface respectively;

a drive shaft directly coupled to said variable speed motor and being rotated along clockwise and counter clockwise directions registered orthogonally to said first synchronous path;

a drive pulley statically attached to said drive shaft and being contemporaneously rotated with said drive shaft along said clockwise and counter clockwise directions;

a driven pulley axially offset from said drive pulley;

a drive chain wrapped about said drive and driven pulleys respectively such that said drive and driven pulleys synchronously rotate along the clockwise and counter clockwise directions and further rotate about mutually exclusive axes extending parallel to each other; and a rectilinear driven shaft spanning along said major width of said frame and being coaxially aligned with said driven pulley, said driven shaft further being statically affixed to said driven pulley and thereby rotating in sync therewith;

wherein said frame remains statically positioned on the ground surface while said driven shaft rotates.

3. The automated jump rope exercising device of claim 2, wherein axially opposed ends of said driven shaft are statically mated to said auxiliary driven pulley systems respectively.

4. The automated jump rope exercising device of claim 3, wherein each of said auxiliary driven pulley systems comprises:

a first driven gear statically affixed to a corresponding one of said driven shaft ends;

a driven chain wrapped about said first driven gear; and a second driven gear statically affixed to a corresponding one of said arms and being situated at a top end of said frame, said second driven gear further being operably coupled to said driven chain such that said corresponding arm is caused to rotated in sync with said driven shaft.

5. The automated jump rope exercising device of claim 4, wherein each of said arms have single and unitary rectilinear shapes such that said arms linearly extend parallel to said driven shaft.

6. The automated jump rope exercising device of claim 5, wherein each of said arms further comprises:

a drive wheel statically mounted about a corresponding one of said arms such that said drive wheel is rotatably in sync therewith;

a rope clutch detachably connected to said drive wheel and being caused to rotated in sync therewith, said rope clutch further being rotatably coupled about said corresponding arm; and a terminal wheel releasably coupled to said rope clutch and rotatably affixed about said corresponding arm, said terminal wheel being caused to rotate about said corresponding arm and along said second synchronous path when said rope clutch is engaged with said terminal wheel such that said terminal wheel is coaxially rotated in sync with said rope clutch and said drive wheel during rope jumping procedures;

wherein said rope clutch is axially displaced along said corresponding arm and away from said terminal wheel when said tension of said ropes rise above a maximum threshold tension level such that said rope clutch becomes disengaged from said terminal wheel and said drive wheel to thereby disable a rotational movement of said ropes along said third synchronous path respectively;

wherein disengagement of said rope clutch from said terminal and drive wheels permits said ropes to remain at a static non-rotational position while said corresponding arm and said drive wheel freely rotate along said second rotational direction.

7. The automated jump rope exercising device of claim 6, wherein each of said terminal wheels comprises:

a pair of diametrically opposed rectilinear rods extending radially away from a corresponding one of said terminal wheels respectively, said ropes being affixed to distal ends of said rods such that said ropes are prohibited from rotating along said third synchronous path when said tension levels rise above said maximum threshold tension level respectively.

8. The automated jump rope exercising device of claim 7, wherein said frame comprises:

a rear brace adapted to be situated on the ground surface and spanning along said major width of said frame;

a plurality of rectilinear stanchions vertically oriented anterior of said rear brace; and a plurality of rectilinear lateral braces having axially opposed ends coupled to said rear brace and top ends of said stanchions respectively such that said lateral braces remain oriented along an angular position offset from a vertical plane.

9. The automated jump rope exercising device of claim 8, wherein each of said arm comprises:

a resilient spring member concentrically situated thereabout and configured in such a manner that said spring member compresses along a rectilinear path defined parallel to said rear brace and a longitudinal length of said arms when the rope tension levels are above the maximum rope tension level respectively; and a locking member removably coupled to a medial end of each said arms respectively for prohibiting said spring member from prematurely disengaging said arm during compression and expansion movements;

wherein said spring member remains at equilibrium along said rectilinear path as said ropes rotate along said third synchronous path and maintain the rope tension levels below said maximum threshold tension level such that said terminal wheel remains axially urged against said rope clutch to maintain direct engagement therewith;

wherein said spring member is urged to a stressed position by compressing along a second direction defined along said rectilinear path when the tension level of said ropes rise above said maximum threshold tension level such that said terminal wheel is axially retracted away from said rope clutch and thereby stops rotating along said second synchronous path.

10. An automated jump rope exercising device for enabling a single user to independently practice jump rope activities, said automated jump rope exercising device comprising:

a frame adapted to be placed on a ground surface;

a power operated primary drive pulley system anchored to said frame and being selectively operable based upon receipt of a user input;

a plurality of auxiliary driven pulley systems mechanically coupled to said primary drive pulley system while being spaced at opposed lateral sides of said frame respectively, each of said auxiliary driven pulley systems being simultaneously rotated in a first synchronous path during operating conditions based upon receipt of an input from said primary drive pulley respectively;

a plurality of arms conjoined to said auxiliary driven pulley systems respectively, each of said arms being simultaneously rotated in a second synchronous path during operating conditions based upon receipt of an input from said auxiliary driven pulleys respectively;

a plurality of ropes anchored to said arms respectively, each of said ropes being simultaneously rotated in a third synchronous path during operating conditions based upon receipt of an input from said arms respectively, wherein said ropes span along a major width of said frame and remain inwardly situated from said auxiliary driven pulley systems respectively; and a user interface coupled to said primary drive pulley system for generating and transmitting a control signal thereto upon receipt of the user input, said control signal for adapting a rotational speed of said arms and thereby permitting the user to selectively adjust a tension level of said ropes during operating conditions;

wherein said first and second synchronous paths are registered orthogonal to each other;

wherein said second and third synchronous paths are coaxially oriented about a fulcrum axis defined at an upper end of said frame.

11. The automated jump rope exercising device of claim 10, wherein said primary drive pulley system comprises:

a variable speed motor connected to said frame and said user interface respectively;

a drive shaft directly coupled to said variable speed motor and being rotated along clockwise and counter clockwise directions registered orthogonally to said first synchronous path;

a drive pulley statically attached to said drive shaft and being contemporaneously rotated with said drive shaft along said clockwise and counter clockwise directions;

a driven pulley axially offset from said drive pulley;

a drive chain wrapped about said drive and driven pulleys respectively such that said drive and driven pulleys synchronously rotate along the clockwise and counter clockwise directions and further rotate about mutually exclusive axes extending parallel to each other; and a rectilinear driven shaft spanning along said major width of said frame and being coaxially aligned with said driven pulley, said driven shaft further being statically affixed to said driven pulley and thereby rotating in sync therewith;

wherein said frame remains statically positioned on the ground surface while said driven shaft rotates.

12. The automated jump rope exercising device of claim 11, wherein axially opposed ends of said driven shaft are statically mated to said auxiliary driven pulley systems respectively.

13. The automated jump rope exercising device of claim 12, wherein each of said auxiliary driven pulley systems comprises:

a first driven gear statically affixed to a corresponding one of said driven shaft ends;

a driven chain wrapped about said first driven gear; and a second driven gear statically affixed to a corresponding one of said arms and being situated at a top end of said frame, said second driven gear further being operably coupled to said driven chain such that said corresponding arm is caused to rotated in sync with said driven shaft.

14. The automated jump rope exercising device of claim 13, wherein each of said arms have single and unitary rectilinear shapes such that said arms linearly extend parallel to said driven shaft.

15. The automated jump rope exercising device of claim 14, wherein each of said arms further comprises:

a drive wheel statically mounted about a corresponding-one of said arms such that said drive wheel is rotatably in sync therewith;

a rope clutch detachably connected to said drive wheel and being caused to rotated in sync therewith, said rope clutch further being rotatably coupled about said corresponding arm; and a terminal wheel releasably coupled to said rope clutch and rotatably affixed about said corresponding arm, said terminal wheel being caused to rotate about said corresponding arm and along said second synchronous path when said rope clutch is engaged with said terminal wheel such that said terminal wheel is coaxially rotated in sync with said rope clutch and said drive wheel during rope jumping procedures;

wherein said rope clutch is axially displaced along said corresponding arm and away from said terminal wheel when said tension of said ropes rise above a maximum threshold tension level such that said rope clutch becomes disengaged from said terminal wheel and said drive wheel to thereby disable a rotational movement of said ropes along said third synchronous path respectively;

wherein disengagement of said rope clutch from said terminal and drive wheels permits said ropes to remain at a static non-rotational position while said corresponding arm and said drive wheel freely rotate along said second rotational direction.

16. The automated jump rope exercising device of claim 15, wherein each of said terminal wheels comprises:

a pair of diametrically opposed rectilinear rods extending radially away from a corresponding one of said terminal wheels respectively, said ropes being affixed to distal ends of said rods such that said ropes are prohibited from rotating along said third synchronous path when said tension levels rise above said maximum threshold tension level respectively.

17. The automated jump rope exercising device of claim 16, wherein said frame comprises:

a rear brace adapted to be situated on the ground surface and spanning along said major width of said frame;

a plurality of rectilinear stanchions vertically oriented anterior of said rear brace; and a plurality of rectilinear lateral braces having axially opposed ends coupled to said rear brace and top ends of said stanchions respectively such that said lateral braces remain oriented along an angular position offset from a vertical plane.

18. The automated jump rope exercising device of claim 17, wherein each of said arm comprises:

a resilient spring member concentrically situated thereabout and configured in such a manner that said spring member compresses along a rectilinear path defined parallel to said rear brace and a longitudinal length of said arms when the rope tension levels are above the maximum rope tension level respectively; and a locking member removably coupled to a medial end of each said arms respectively for prohibiting said spring member from prematurely disengaging said arm during compression and expansion movements;

wherein said spring member remains at equilibrium along said rectilinear path as said ropes rotate along said third synchronous path and maintain the rope tension levels below said maximum threshold tension level such that said terminal wheel remains axially urged against said rope clutch to maintain direct engagement therewith;

wherein said spring member is urged to a stressed position by compressing along a second direction defined along said rectilinear path when the tension level of said ropes rise above said maximum threshold tension level such that said terminal wheel is axially retracted away from said rope clutch and thereby stops rotating along said second synchronous path.

19. A method for enabling a single user to independently practice jump rope activities, said method comprising the chronological steps of:

a. providing a frame placed on a ground surface;

b. providing a power operated primary drive pulley system anchored to said frame;

c. providing a user interface coupled to said primary drive pulley system such that said primary drive pulley system is selectively operable as desired by the user;

d. providing at least two auxiliary driven pulley systems mechanically coupled to said primary drive pulley system while maintaining said auxiliary driven pulley systems spaced at opposed lateral sides of said frame respectively;

e. providing a plurality of arms conjoined to said auxiliary driven pulley systems respectively;

f. providing a plurality of ropes detachably anchored to said arms respectively;

g.

adapting a rotational speed of said arms and thereby permitting the user to selectively adjust a tension level of ropes during operating conditions by generating and transmitting a user input to said user interface;

h. in response to receiving said user input, said user interface generating and transmitting a control signal to said primary drive pulley system;

i. in response to receiving said control signal, said primary drive pulley system generating and transmitting an input to each of said auxiliary driven pulley systems;

j. in response to receiving said input from said primary drive pulley system, said auxiliary driven pulley systems being simultaneously rotated in a first synchronous path during operating conditions;

k. said auxiliary driven pulley systems generating and transmitting an input to said arms respectively;

l. in response to receiving said input from said auxiliary driven pulley systems, said arms being simultaneously rotated in a second synchronous path during operating conditions;

m. said arms generating and transmitting an input to said ropes respectively; and n. in response to receiving said input from said arms, each of said ropes being simultaneously rotated in a third synchronous path during operating conditions respectively;

wherein said ropes span along a major width of said frame and remain inwardly situated from said auxiliary driven pulley systems respectively;

wherein said first and second synchronous paths are registered orthogonal to each other;

wherein said second and third synchronous paths are coaxially oriented about a fulcrum axis defined at an upper end of said frame.

* * * * *